US008999911B2

(12) United States Patent
Armstrong et al.

(10) Patent No.: US 8,999,911 B2
(45) Date of Patent: Apr. 7, 2015

(54) ENZYME CLEANING COMPOSITION AND METHOD OF USE

(71) Applicant: BISSELL Homecare, Inc., Grand Rapids, MI (US)

(72) Inventors: Kathryn M. Armstrong, Grand Rapids, MI (US); Kevin L. Haley, Byron Center, MI (US); Eric J. Hansen, Ada, MI (US); Joseph A. Fester, Ada, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 0 days.

(21) Appl. No.: 13/667,392

(22) Filed: Nov. 2, 2012

(65) Prior Publication Data

US 2013/0116162 A1 May 9, 2013

Related U.S. Application Data

(60) Provisional application No. 61/555,723, filed on Nov. 4, 2011.

(51) Int. Cl.

| | |
|---|---|
| ***C11D 17/04*** | (2006.01) |
| ***C11D 3/386*** | (2006.01) |
| ***C11D 7/42*** | (2006.01) |
| ***C11D 7/02*** | (2006.01) |
| ***C11D 7/24*** | (2006.01) |
| ***C11D 7/26*** | (2006.01) |

(52) U.S. Cl.

CPC *C11D 3/386* (2013.01); *C11D 7/02* (2013.01); *C11D 7/24* (2013.01); *C11D 7/242* (2013.01); *C11D 7/265* (2013.01)

(58) Field of Classification Search

USPC ..... 510/439, 392, 406, 108, 180, 238, 243, 510/277, 278, 320, 461

See application file for complete search history.

(56) References Cited

U.S. PATENT DOCUMENTS

| | | | | | |
|---|---|---|---|---|---|
| 4,243,543 | A | * | 1/1981 | Guilbert et al. | 510/234 |
| 4,243,546 | A | | 1/1981 | Shaer | |
| 4,421,664 | A | | 12/1983 | Anderson et al. | |
| 4,655,794 | A | * | 4/1987 | Richardson et al. | 510/393 |
| 4,711,739 | A | | 12/1987 | Kandathil | |
| 4,801,544 | A | | 1/1989 | Munk | |
| 5,030,240 | A | | 7/1991 | Wiersema et al. | |
| 5,320,805 | A | * | 6/1994 | Kramer et al. | 422/28 |
| 5,630,884 | A | | 5/1997 | Huth | |

(Continued)

FOREIGN PATENT DOCUMENTS

| | | | |
|---|---|---|---|
| DE | 10304331 | A1 | 8/2004 |
| EP | 0181041 | A2 | 5/1986 |

(Continued)

OTHER PUBLICATIONS

Patricia Neys, European Search Report, Jul. 3, 2013, 4 pages, The Hague, (EP 13163152).

(Continued)

*Primary Examiner* — Lorna M Douyon

(74) *Attorney, Agent, or Firm* — McGarry Bair PC

(57) ABSTRACT

A cleaning composition for treating a surface comprises a purified enzyme and an enzyme denaturant system. The enzyme denaturant system is configured to denature the purified enzyme such that any residue remaining on the surface after the treatment of the surface is virtually free of active purified enzymes.

6 Claims, 1 Drawing Sheet

(56) References Cited

U.S. PATENT DOCUMENTS

| | | | | |
|---|---|---|---|---|
| 5,674,829 | A * | 10/1997 | Martin | 510/383 |
| 5,858,117 | A | 1/1999 | Oakes et al. | |
| 6,210,639 | B1 | 4/2001 | Vlass et al. | |
| 6,225,276 | B1 | 5/2001 | Gassenmeier et al. | |
| 6,750,193 | B1 | 6/2004 | Holderbaum et al. | |
| 6,974,691 | B2 | 12/2005 | Fredenburgh et al. | |
| 6,998,369 | B2 * | 2/2006 | Hei et al. | 510/111 |
| 7,073,226 | B1 | 7/2006 | Lenkiwicz et al. | |
| 7,179,780 | B2 | 2/2007 | Forth et al. | |
| 7,225,503 | B1 | 6/2007 | Lenkiwicz et al. | |
| 7,228,589 | B2 | 6/2007 | Miner et al. | |
| 7,255,112 | B2 | 8/2007 | Geret et al. | |
| 7,390,404 | B2 * | 6/2008 | Heppenstall et al. | 210/205 |
| 7,448,556 | B2 | 11/2008 | Muehlhausen et al. | |
| 7,685,671 | B2 | 3/2010 | Jansen | |
| 7,784,148 | B2 | 8/2010 | Lenkiwicz et al. | |
| 7,906,473 | B2 | 3/2011 | Williams et al. | |
| 7,967,220 | B2 | 6/2011 | Hansen et al. | |
| 2002/0082184 | A1 | 6/2002 | Teasdale et al. | |
| 2002/0182184 | A1 | 12/2002 | Pearl | |
| 2004/0106534 | A1 | 6/2004 | Nitsch et al. | |
| 2005/0020466 | A1 * | 1/2005 | Man et al. | 510/392 |
| 2006/0293212 | A1 | 12/2006 | Griese et al. | |
| 2007/0027053 | A1 | 2/2007 | Di Bono | |
| 2007/0196353 | A1 | 8/2007 | Payton | |
| 2008/0023031 | A1 * | 1/2008 | Kellar et al. | 134/6 |
| 2009/0105111 | A1 * | 4/2009 | Stolte et al. | 510/392 |
| 2009/0108021 | A1 | 4/2009 | Hansen et al. | |
| 2009/0236363 | A1 | 9/2009 | Haley et al. | |
| 2010/0154822 | A1 * | 6/2010 | Reed et al. | 134/6 |
| 2010/0159509 | A1 * | 6/2010 | Xu et al. | 435/41 |
| 2010/0173819 | A1 | 7/2010 | Geret et al. | |
| 2011/0146720 | A1 | 6/2011 | Huffman | |
| 2011/0179591 | A1 | 7/2011 | Perry et al. | |

FOREIGN PATENT DOCUMENTS

| | | | |
|---|---|---|---|
| EP | 0533239 | A2 | 3/1993 |
| EP | 1103594 | A2 | 5/2001 |
| GB | 1242247 | | 8/1971 |
| GB | 1264916 | A | 2/1972 |
| WO | 9606910 | A2 | 3/1996 |
| WO | 9729788 | A1 | 8/1997 |
| WO | 9807817 | A1 | 2/1998 |
| WO | 9947631 | A1 | 3/1999 |
| WO | 0026334 | A1 | 5/2000 |
| WO | 2008114171 | A1 | 9/2008 |
| WO | 2009044098 | A2 | 4/2009 |

OTHER PUBLICATIONS

Patricia Neys, Partial European Search Report, Jan. 24, 2013, The Hague, European Patent Office, 5 pages, (EP12191199).

* cited by examiner

ENZYME CLEANING COMPOSITION AND METHOD OF USE

CROSS-REFERENCE TO RELATED APPLICATION

This application claims the benefit of U.S. Provisional Patent Application No. 61/555,723, filed Nov. 4, 2011, which is incorporated herein by reference in its entirety.

BACKGROUND

Cleaning compositions can be used to treat and/or remove soils and stains from soft surfaces, such as fabrics, carpets, rugs and upholstery, and hard surfaces, such as wood, stone, tile, granite, ceramic, laminate, plastic and glass. Cleaning compositions can also be used to sanitize, sterilize or otherwise disinfect surfaces to destroy or render innocuous bacteria, viruses, fungus and mites. Cleaning compositions can be provided with a variety of components to facilitate the cleaning action of the composition, such as oxidizing agents and enzymes. Hydrogen peroxide is an example of an oxidizing agent used in cleaning compositions to facilitate cleaning and sanitizing surfaces. Enzymes such as proteases, amylases and lipases can also be used to facilitate cleaning and sanitizing surfaces. The use of both oxidizing agents and enzymes can further enhance the cleaning and sanitizing capabilities of a composition.

Oxidizing agents, such as bleach or hydrogen peroxide, can interact with enzymes and degrade the enzymes such that they become partially or completely inactivated in the cleaning composition. Oxidizing agents can also interact with some stains such that the stain becomes unsusceptible to the enzyme.

To address the incompatibility of oxidizing agents and enzymes in cleaning compositions, the cleaning composition can be configured so as to delay the release of the oxidizing agent until after the enzymes have had a chance to treat the surface. For example, U.S. Publication No. 2007/0027053 to Di Bono, published Feb. 1, 2007 and titled "Detergent Composition Comprising Coated Bleach Particle," discloses a composition comprising a bleaching agent encapsulated in a coating that is digestible by enzymes present in the composition. The bleaching agent is released into solution once the enzymes digest the coating. U.S. Pat. No. 4,421,664 to Anderson et al., issued Dec. 20, 1983 and titled "Compatible Enzyme and Oxidant Bleaches Containing Cleaning Composition," discloses a cleaning composition comprising an enzyme and a slow release oxidizing bleach. An effective amount of a reducing agent is present in the cleaning composition to deactivate the oxidizing bleach to permit the enzymes to degrade biochemical soils before the bleaching action begins. U.S. Pat. No. 6,225,276 to Gassenmeier et al., issued May 1, 2001 and titled "Ph-Controlled Release of Detergent Components," discloses a detergent composition comprising a bleaching agent which is coated with a coating that dissolves slowly in water, delaying the release of the bleaching agent into the water such that enzymatic cleaning can take place before most of the bleaching agent is present.

U.S. Pat. No. 6,225,276 to Gassenmeier et al. also discloses an advantage of delaying the release of the oxidizing agent until after the enzymatic cleaning has occurred is that the oxidizing agent destroys any excess enzymes to prevent the enzymes from remaining on the laundry, which can result in odor formation.

BRIEF SUMMARY

According to one embodiment, a cleaning composition for treating a surface comprises a purified enzyme and an enzyme denaturant system. The enzyme denaturant system is configured to denature the purified enzyme to decrease a concentration of the purified enzyme in residue remaining on the surface after application of the cleaning composition to the surface.

DETAILED DESCRIPTION

As used herein, a cleaning composition can be any composition which is capable of treating soils, stains, biological organisms and/or infectious agents on surfaces. Treating a surface can include disinfecting, sterilizing, sanitizing and/or removing soils and stains from the surface. As used herein, disinfecting, sterilizing and sanitizing are used interchangeably to refer to killing, destroying, inhibiting growth and reproduction, or otherwise rendering innocuous biological organisms, such as bacteria, protists, fungus and mites, for example, and infectious agents, such viruses and prions, for example. The cleaning composition can be used on soft surfaces, such as fabrics, carpets, rugs, window treatments and upholstery, and hard surfaces, such as wood, stone, tile, granite, ceramic, laminate, plastic and glass, for example.

Figure 1:
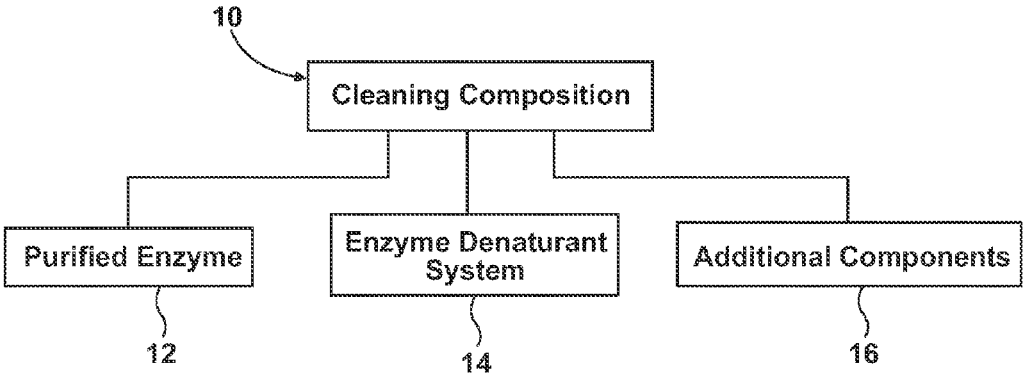
FIG. 1 is a schematic representation of a cleaning composition according to an embodiment of the invention.

As illustrated schematically in FIG. 1, a cleaning composition 10 comprises at least one purified enzyme 12, an enzyme denaturant system, 14 and additional components 16. The purified enzyme 12 can be an enzyme which has been isolated from any suitable source such as the cells, subcellular fractions, tissues, culture media or matrix of plants, animals or microorganisms, for example, or may be synthetically created. Non-limiting exemplary types of enzymes suitable for use in treating a surface include enzymes which catalyze the breakdown of carbohydrates, such as amylases, enzymes that catalyze the breakdown of fats, such as lipases, and enzymes that catalyze the breakdown of peptide bonds (proteolysis), such as proteases. The purified enzyme 12 can be a single type of enzyme or a mixture of one or more different types of enzymes. The amount and type of each enzyme can be determined based on the intended use of the cleaning composition 10 according to known methods.

The enzyme denaturant system 14 can be any material or combination of materials capable of denaturing the purified enzymes 12 present in the cleaning composition 10 to inactivate the purified enzymes 12 and decrease the ability of the purified enzymes 12 to become airborne. As used herein, denaturing refers to any process by which an enzyme is chemically and/or physically altered such that the enzyme is deactivated, destroyed or otherwise rendered unable to interact with a substrate. Non-limiting examples of denaturing an enzyme include cleaving the enzyme at one or more locations or digesting the enzyme into smaller pieces, blocking or altering the active site of the enzyme, and inducing a conformational change in the enzyme. In one exemplary cleaning composition 10, the enzyme denaturant system 14 includes a chemical denaturant such as hydrogen peroxide. In another example, the enzyme denaturant system 14 includes enzymes capable of digesting the purified enzymes 12. The enzymes capable of digesting the purified enzymes 12 can be non-specific enzymes, such as non-specific proteases, or enzymes having specificity for one or more of the purified enzymes 12 present in the cleaning composition 10. In this example, the residual enzyme remaining on the surface from the enzyme denaturant system 14 would be configured to remain at a lower concentration than the original purified enzymes 12 and/or comprise enzymes that have little or no potential for becoming airborne. In yet another example, the enzyme denaturant system 14 includes a chemical that alters the pH of the cleaning composition to a pH that denatures the purified enzymes 12.

In yet another example, the enzyme denaturant system 14 can include heat, alone or in combination with a pH change, to denature the purified enzymes 12. In this example, the enzyme denaturant system 14 can include a cleaning solution that generates heat from an exothermic reaction between one or more of the components of the cleaning solution, such as an acid and base. In another example, the enzyme denaturant system 14 can comprise a limestone component which reacts with water on the surface to be treated to generate heat. The use of acids and/or bases in the enzyme denaturant system 14 can also be utilized to provide the cleaning composition with a change in pH that denatures the purified enzymes 12.

In yet another example, the enzyme denaturant system 14 can include metals, such as divalent metals, to deactivate the purified enzymes 12.

The additional components 16 can include any materials or combinations of materials known in the art for treating a surface to sanitize and/or remove soil and stains from the surface, non-limiting examples of which include surfactants, solvents, anti-stain/anti-soil agents, oxidizing agents, water, fragrances, colorants, buffers, stabilizers, polymers, enzyme producing microorganisms, enzymes and chelating agents. Examples of suitable cleaning compositions that can be used with the purified enzymes as disclosed herein can be found in U.S. Pat. No. 7,906,473 to Williams et al., issued Mar. 15, 2011 and U.S. Patent Publication No. 2009/0108021 to Hansen et al., published Apr. 30, 2009 and issued as U.S. Pat. No. 7,967,220 on Jun. 28, 2011, all of which are incorporated herein by reference in full.

In one exemplary cleaning composition 10, the enzyme denaturant system 14 includes digesting enzymes and a chemical denaturant encapsulated in a material that is digestible by the digesting enzymes provided within the cleaning composition 10. As the enzymes digest the encapsulating material, the chemical denaturant is released and becomes available for denaturing the purified enzymes 12. For example, the enzyme denaturant system 14 can include a chemical denaturant encapsulated within a protein shell, such as gelatin, for example, that is digestible by proteases provided in the cleaning composition 10. The proteases can be provided within the cleaning composition 10 for the purpose of digesting the protein shell and may also contribute to the cleaning process. In one example, the encapsulation material can be a carbohydrate, such as a starch that is susceptible to digestion by an amylase enzyme. In another example, the encapsulation material can be a cellulosic material that would be susceptible to digestion by a cellulase. In yet another example, the encapsulation material can be a lipid that is susceptible to digestion by a lipase. Alternatively, the encapsulation material can be any polymer that is susceptible to enzymatic digestion/degradation, such as polyvinyl alcohol (PVA) or vinyl acetate copolymers (PVA).

The components of the enzyme denaturant system 14, the encapsulated chemical denaturant and the digesting enzymes, can be stored separately such that the encapsulated chemical denaturant is not released until the cleaning composition 10 is applied to the surface to be treated. When the digesting enzymes and the encapsulated chemical denaturant are dispensed from their respective containers, the digesting enzymes will begin digesting the encapsulating material surrounding the chemical denaturant, releasing the chemical denaturant into the surrounding solution.

In another exemplary cleaning composition 10, the enzyme denaturant system 14 can include bacteria in a form that is temporarily dormant, non-reproductive and/or in a diminished metabolic state, that are capable of producing a chemical denaturant. In one example, the cleaning composition 10 can be provided with dormant bacterial spores that upon germination, produce a chemical denaturant capable of denaturing the purified enzymes 12. The enzyme denaturant system 14 can include a triggering agent that initiates the germination process in the bacterial spores when the cleaning composition 10 is applied to the surface to be treated. One example of a triggering agent includes water. The triggering agent can be stored separately from the dormant bacterial spores such that germination is not initiated until the cleaning composition 10 is applied to the surface to be treated. It is also within the scope of the invention for the enzyme denaturant system 14 to include vegetative bacteria that are already in a state of growth and reproduction.

Non-limiting examples of suitable chemical denaturants include oxidizing agents, such as hydrogen peroxide, reducing agents, and pH modifiers, such as sodium hydroxide, ammonia, citric acid, lactic acid and acetic acid, for example.

Alternatively, the dormant bacterial spores can produce enzymes upon germination that are capable of denaturing the purified enzymes 12. The bacterial spores can be designed to produce non-specific and/or specific enzymes capable of denaturing the purified enzymes 12. For example, upon germination, the bacterial spores can produce non-specific proteases capable of denaturing the purified enzymes 12.

In another exemplary cleaning composition 10, the enzyme denaturant system 14 can be a chemical that denatures the purified enzymes 12 as the water in the cleaning composition 10 evaporates. For example, the enzyme denaturant system 14 can include a pH modifier which would change the pH of the cleaning composition 10 as the water evaporates from a dispensed aliquot of the cleaning composition 10 after the cleaning composition 10 has been applied to the surface to be treated. Non-limiting examples of non-volatile pH modifiers that can change the pH of the cleaning composition 10 as the water evaporates include sodium hydroxide, citric acid and lactic acid. The pH modifier can be an acid or a base. As the water evaporates from the dispensed aliquot, the acid or base concentration increases, eventually reaching a pH at which the purified enzymes 12 are denatured. The type and concentration of acid or base can be selected based on the type and concentration of the purified enzymes 12. Decreasing the pH can also have the beneficial effect of improving the feel of soft surfaces, such as carpet, that has been treated with the cleaning composition 10.

In another example, the enzyme denaturant system 14 can include a water immiscible solvent that is less dense than water and evaporates slower than water. Non-limiting examples of suitable solvents include mineral spirits and isoparaffinic hydrocarbons. Alternatively, or in addition, the enzyme denaturant system 14 can include a chemical denaturant that is soluble in the water immiscible solvent and insoluble or only sparingly soluble in water. When the cleaning composition 10 is applied to the surface to be treated, the less dense water immiscible solvent can form a layer on top of the water, with the purified enzymes 12 preferentially distributed into the water layer. As the water evaporates, the purified enzymes 12 can come into contact with the water immiscible solvent and the optional chemical denaturant carried by the water immiscible solvent. The water immiscible solvent and/or the chemical denaturant can denature the purified enzymes 12 upon contact with the purified enzymes 12 as the water evaporates.

Alternatively, rather than being carried in a solvent, the water insoluble or sparingly soluble chemical denaturant can be suspended in at least a portion of the cleaning composition 10. As the water evaporates, the purified enzymes 12 can come into contact with the insoluble or sparingly soluble chemical denaturant, subsequently denaturing the purified enzyme 12. Non-limiting examples of insoluble or sparingly soluble chemical denaturants include water insoluble acid and base based enzyme denaturants such as long carbon chain carboxylic acids (e.g. C4 and larger, including many fatty acids), benzoic acid and benzoic acid based derivatives, acetylsalicylic acid, calcium hydroxide, strontium hydroxide and barium hydroxide. While not meant to limited by any theory, many of the water insoluble acid and base based enzyme denaturants may denature the enzyme by directly interacting with the enzyme. The water insoluble acids and bases may also effect the pH of the composition as the water evaporates in such a manner as to induce a pH change significant enough to contribute to denaturing the enzyme.

The water immiscible solvent itself can also act as the chemical denaturant to denature the purified enzymes 12. For example, the water immiscible solvent can be a hydrophobic hydrocarbon-based solvent which denatures the purified enzymes 12 by inducing a structural change in the purified enzymes 12 as the purified enzymes 12 encounter the hydrophobic environment of the solvent as the water evaporates.

Figure 2:
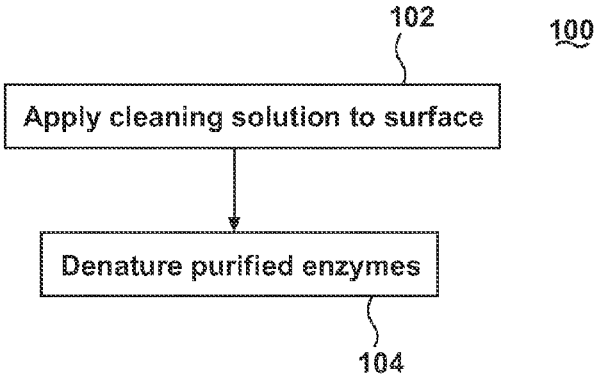
FIG. 2 is a flow chart of a method of use of the cleaning composition of FIG. 1 according to an embodiment of the invention.

FIG. 2 illustrates a method 100 of treating a surface using the cleaning composition 10 comprising a purified enzyme 12 and an enzyme denaturant system 14. The method 100 includes applying the cleaning composition 10 to a surface to be treated at 102 followed by the denaturing of the purified enzyme 12 at 104 by the enzyme denaturant system 14.

The cleaning composition 10 can be applied at 102 either manually by the user or automatically. For example, the cleaning composition 10 can be applied manually by a user to the surface using a sponge, pad, sheet, cloth or by spraying, misting or pouring the cleaning composition 10 onto the surface to be treated. In another example, the composition 10 can be applied with a cleaning pad assembly that can comprise a non-woven pad that is impregnated with the composition 10. Alternatively, the composition 10 can be delivered by a package comprising a housing and sealed, pierceable packet as more fully described in U.S. Pat. No. 8,567,418, issued Oct. 29, 2013, titled "Stain Treatment and Removal", which is assigned to BISSELL Homecare, Inc. and incorporated herein by reference in its entirety. The cleaning composition can also be applied automatically by a carpet cleaning machine, spot cleaning machine or stick cleaner having a dispensing system, examples of which include: U.S. Pat. No. 7,073,226 to Lenkiewicz, U.S. Pat. No. 7,225,503 to Lenkiewicz et al., U.S. Pat. No. 7,228,589 to Miner et al., U.S. Pat. No. 7,685,671 to Jansen, U.S. Pat. No. 7,784,148 to Lenkiewicz et al., U.S. Pat. No. 8,641,309, issued Feb. 4, 2014, titled "Surface Treating Implement", and U.S. Pat. No. 8,631,538, issued Jan. 21, 2014, titled "Dry Vacuum Cleaner with Spot Cleaning", all assigned to BISSELL Homecare, Inc., and all of which are incorporated herein by reference in full.

The purified enzyme 12 and the components of the enzyme denaturant system 14 can be stored together or separately within a dispenser depending on the nature of the enzyme denaturant system 14. When the enzyme denaturant system 14 is configured to denature the purified enzyme 12 as the water evaporates from a dispensed aliquot of cleaning composition 10, the purified enzyme 12 and the enzyme denaturant system 14 can be stored in the same container. One example of a suitable container is disclosed in U.S. Pub. No. 2009/0236363, published Sep. 24, 2009, titled "Manual Spray Cleaner", assigned to the present assignee, which is herein incorporated by reference in full.

The purified enzyme 12 and the components of the enzyme denaturant system 14 can be stored together or separately within a dispenser depending on the nature of the enzyme denaturant system 14. When the enzyme denaturant system 14 is configured to denature the purified enzyme 12 as the water evaporates from a dispensed aliquot of cleaning composition 10, the purified enzyme 12 and the enzyme denaturant system 14 can be stored in the same container. One example of a suitable container is disclosed in U.S. application Ser. No. 12/403,777, filed Mar. 13, 2009, titled "Manual Spray Cleaner", assigned to the present assignee, which is herein incorporated by reference in full.

Alternatively, the purified enzyme 12 and the components of the enzyme denaturant system 14 can be stored in separate containers or within separated chambers within a single container. U.S. Pat. No. 7,906,473 to Williams et al. and U.S. Patent Publication No. 2009/0108021 to Hansen et al., which issued as U.S. Pat. No. 7,967,220 on Jun. 28, 2011, both of which are incorporated by reference in full, disclose dispensers having two separate containers for storing and dispensing material stored within the two separate containers. U.S. Pat. No. 7,906,473 to Williams et al. discloses trigger-type and aerosol-type dispensers having a single dispensing system for dispensing material from the two separate containers. U.S. Pat. No. 7,967,220 to Hansen et al. discloses dual bag-on-valve containers having a single dispensing system for dispensing material from the two separate containers. In another example, the dispenser can comprise a dual chamber squeeze bottle which when squeezed dispenses material stored in both chambers.

When the enzyme denaturant system 14 includes digesting enzymes and a chemical denaturant encapsulated in a material digestible by enzymes, the digesting enzymes can be stored in one of the containers and the encapsulated chemical denaturant can be stored in the other container. In this manner the encapsulated chemical denaturant and the digesting enzymes are stored separately until the cleaning composition 10 is dispensed onto the surface. Additional components of the cleaning composition 10, including the purified enzymes 12, can be stored in either of the containers depending on the compatibility of the components.

In the exemplary cleaning compositions 10 in which the enzyme denaturant system 14 includes bacterial spores that produce a chemical denaturant or denaturing enzymes, the cleaning composition can be provided in a package having first and second compartments in which the bacterial spores can be stored separately from the purified enzymes or the triggering agent. For example, the cleaning composition 10 can be stored in a dual container dispenser having separate chambers or storage pouches with the bacterial spores stored in one chamber or pouch and the triggering agent stored in the other chamber or pouch. The bacterial spores and triggering agent can mix when the materials are dispensed from their respective chambers such that the triggering agent activates the bacterial spores to produce the enzyme denaturant. In another example, the bacterial spores and the triggering agent can be stored in separate rupturable packets. The packets can be ruptured simultaneously to dispense both the bacterial spores and the triggering agent onto the surface to be cleaned such that the bacterial spores and the triggering agent mix.

The dispenser for the cleaning composition 10 can be configured to dispense the cleaning composition as a spray, mist, aerosol, foam or stream. When the cleaning composition 10 is stored in dispensers having multiple containers, the dispensing system is configured to dispense material from both containers simultaneously. The dispensing system can be configured to mix the material from the separate containers as the material is dispensed from their respective containers or when the material is applied to the surface. In addition, the dispensing system can be configured to mix the material from the separate containers equally or unequally.

Denaturing the purified enzyme 12 at 104 can begin immediately upon application of the cleaning composition 10 to the surface to be treated or at some delayed time after the application of the cleaning composition 10. The rate of release and/or the timing of release of the enzyme denaturant system 14 can be configured to provide the purified enzyme 12 with time to treat the surface before all of the purified enzyme 12 is denatured.

Figure 3:
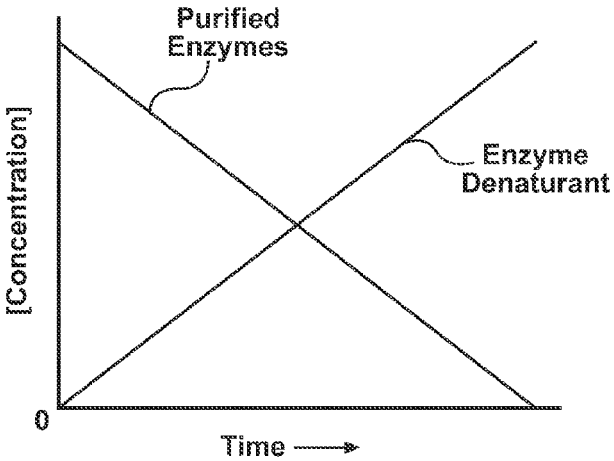
FIG. 3 is a graph illustrating a change in concentration over time according to an embodiment of the invention.

FIG. 3 schematically illustrates the change in concentration of the purified enzyme 12 and the enzyme denaturant component of the enzyme denaturant system 14 over time in an aliquot of cleaning composition 10 that has been applied to a surface to be treated. FIG. 3 is provided for the purposes of discussion only and is not indicative of real data. As illustrated in FIG. 3, at time zero, when the cleaning composition 10 is applied to surface to be treated, the purified enzymes 12 are present at their maximum concentration and the enzyme denaturant is not appreciably present. As the enzyme denaturant is released by the enzyme denaturant system 14 over time, the concentration of the enzyme denaturant increases with a corresponding decrease in the concentration of the purified enzymes 12 as the purified enzymes 12 are denatured by the enzyme denaturant. The release of the enzyme denaturant can be configured so as to provide enough time for the purified enzymes 12 to treat the surface before all of the purified enzymes 12 are denatured. The start of the release of the enzyme denaturant by the enzyme denaturant system 14 can also be delayed to provide the purified enzymes 12 with additional time to treat the surface. For example, dormant bacterial spores require time to germinate before the bacterial spore is capable of producing and releasing the enzyme denaturant.

The composition described herein provides a fast-acting, enzyme-based composition for treating soils, stains, biological organisms and/or infectious agents on surfaces. Typical enzyme-based compositions which use bacterial spores to generate the enzymes require a germination period in which the dormant bacterial spores must first germinate before producing the enzymes for treating the surface. Thus the enzyme activity of these compositions is delayed, increasing the length of time required for treating the surface, which can be an inconvenience to the user.

The compositions described herein use purified enzymes that do not require a germination period before enzyme activity begins, thereby decreasing the length of time required to treat the surface. In addition to the purified enzymes, the cleaning composition includes an enzyme denaturant system capable of denaturing the purified enzymes in the cleaning composition such that any residue remaining on the surface after treatment is virtually free of active purified enzymes. Denaturing the purified enzymes after treatment of the surface prevents the purified enzymes from becoming airborne. The cleaning composition can be packaged in a dispenser such that the enzyme denaturant system is always applied to the surface with the purified enzymes.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A kit for application of a cleaning composition to a surface to be treated comprising:

a package comprising:

a first compartment and a second compartment;

a first composition comprising at least one purified enzyme stored in the first compartment; and a second composition comprising bacterial spores stored in the second compartment, separate from the first composition, wherein the bacterial spores are adapted to produce an enzyme denaturant;

wherein when the first composition and the second composition are mixed during application of the cleaning composition to the surface, the enzyme denaturant produced by the bacterial spores denatures the at least one purified enzyme to decrease a concentration of the at least one purified enzyme in residue remaining on the surface after application of the cleaning composition to the surface; and wherein the kit further comprises a dispensing system configured to dispense the first composition from the first compartment and the second composition from the second compartment such that the first composition and the second composition mix as the first and second compositions are dispensed from their respective first and second compartments or as the first and second compositions are applied to the surface.

2. The kit of claim 1 wherein decreasing the concentration of the at least one purified enzyme comprises decreasing the concentration of active purified enzymes that have not been denatured.

3. The kit of claim 1 wherein the denaturant comprises one of a chemical denaturant and an enzyme that reacts with the at least one purified enzyme to denature the at least one purified enzyme.

4. The kit of claim 1 wherein the bacterial spores are in a dormant state in the second compartment and wherein the first composition comprises a triggering agent to initiate a germination process in which the bacterial spores produce the enzyme denaturant when the first and second compositions are mixed.

5. The kit of claim 4 wherein the triggering agent comprises water.

6. The kit of claim 1 wherein the first and second compartments comprise at least one of a container chamber, a pouch, or a rupturable packet.

* * * * *